US009802291B2

(12) United States Patent
Woehrle et al.

(10) Patent No.: US 9,802,291 B2
(45) Date of Patent: Oct. 31, 2017

(54) BELT-FINISHING DEVICE AND METHOD FOR OPERATING A BELT-FINISHING DEVICE

(71) Applicant: Supfina Grieshaber GmbH & Co. KG, Wolfach (DE)

(72) Inventors: Michael Woehrle, Gutach (DE); Marcus Stephan, Fischerbach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 0 days.

(21) Appl. No.: 15/307,864

(22) PCT Filed: Mar. 11, 2015

(86) PCT No.: PCT/EP2015/055078
§ 371 (c)(1),
(2) Date: Oct. 31, 2016

(87) PCT Pub. No.: WO2015/169484
PCT Pub. Date: Nov. 12, 2015

(65) Prior Publication Data

US 2017/0057048 A1 Mar. 2, 2017

(30) Foreign Application Priority Data

May 5, 2014 (DE) ..... 10 2014 208 319

(51) Int. Cl.
*B24B 5/42* (2006.01)
*B24B 21/02* (2006.01)
(Continued)

(52) U.S. Cl.
CPC ..... *B24B 35/00* (2013.01); *B24B 5/42* (2013.01); *B24B 19/12* (2013.01); *B24B 21/004* (2013.01); *B24B 21/02* (2013.01)

(58) Field of Classification Search
CPC ..... B24B 5/42; B24B 35/00; B24B 19/12
(Continued)

(56) References Cited

U.S. PATENT DOCUMENTS 5,683,291 A * 11/1997 Humpert ..... B24B 5/42 451/168
6,159,074 A * 12/2000 Kube ..... B24B 5/00 33/549
(Continued)

FOREIGN PATENT DOCUMENTS

DE 19905139 A1 8/2000
DE 102005013637 B3 8/2006
(Continued)

*Primary Examiner* — Robert Rose
(74) *Attorney, Agent, or Firm* — Leydig, Voit & Mayer, Ltd.

(57) ABSTRACT

A belt-finishing device including a frame. A pressing arm is configured to pivotally mount on the frame. A pressing element, which is used to press a finishing belt against a workpiece surface to be treated, is arranged on the pressing arm. The device is provided with a position detection system for detecting a pressing-arm actual position that deviates from a desired position of the pressing arm. A malfunction or defect of the pressing element is detected by means of the pressing arm actual position that deviates from the desired position of the pressing arm.

13 Claims, 3 Drawing Sheets

(51) Int. Cl.
*B24B 35/00* (2006.01)
*B24B 19/12* (2006.01)
*B24B 21/00* (2006.01)

(58) Field of Classification Search
USPC ..... 451/5, 168, 173, 296, 59, 49, 51
See application file for complete search history.

(56) References Cited

U.S. PATENT DOCUMENTS

| | | | | |
|---|---|---|---|---|
| 2008/0196465 | A1 | 8/2008 | Freitag et al. | |
| 2010/0022167 | A1 | 1/2010 | Billharz | |
| 2010/0236314 | A1* | 9/2010 | Weigmann ..... | B24B 21/02 72/324 |
| 2012/0122375 | A1 | 5/2012 | Schuler | |

FOREIGN PATENT DOCUMENTS

| | | | |
|---|---|---|---|
| DE | 202010006480 | U1 | 8/2010 |
| EP | 0161748 | A2 | 11/1985 |
| EP | 0997229 | A1 | 5/2000 |
| EP | 2212058 | B1 | 8/2006 |
| EP | 2452779 | A1 | 5/2012 |
| EP | 2674248 | A1 | 12/2013 |

* cited by examiner

BELT-FINISHING DEVICE AND METHOD FOR OPERATING A BELT-FINISHING DEVICE

CROSS-REFERENCE TO RELATED APPLICATIONS

This application is a U.S. National Phase application under 35 U.S.C. §371 of International Application No. PCT/EP2015/055078, filed on Mar. 11, 2015, and claims benefit to German Patent Application No. 10 2014 208 319.2, filed on May 5, 2014. The International Application was published in German on Nov. 12, 2015 as WO 2015/169484 under PCT Article 21(2).

FIELD

The invention relates to a belt finishing device including a frame for mounting a pressing arm, in particular pivotally, a pressing element being arranged on the pressing arm, by means of which element a finishing belt can be pressed against a workpiece surface to be treated.

The finishing treatment of a workpiece is a method also described as "super finishing" or "micro finishing method" for the surface treatment of a workpiece. In this method, a finishing tool with abrasive action, for example a finishing stone or a finishing belt, is pressed onto the workpiece surface to be treated. In the process, the workpiece surface to be treated rotates. An oscillating movement is superimposed on this rotation of the workpiece surface to be treated, and during this oscillating movement the finishing tool and the workpiece surface to be treated move relative to one another in directions parallel to the axis of rotation.

BACKGROUND

Devices of the type referred to above are known, for example from DE 20 2010 006 480 U1 and from EP 0 161 748 A2. These publications describe belt finishing devices which have pressing elements that press a finishing belt against a workpiece surface to be finished, each at the height of a pressing element.

DE 20 2010 006 480 U1 proposes the use of rigid or of comparatively soft and yielding pressing elements. The use of rigid pressing elements has the advantage that inaccuracies in an initial geometry of a workpiece to be treated can be at least partially evened out. Such evening out is, however, limited by the resilience of the finishing belt. The use of soft and yielding pressing elements allow for flat contact of the finishing belt onto the workpiece but have the disadvantage that the pressing elements can greatly deform, in particular in the region of drilled oil discharge holes of a crank shaft, and can cause too great material removal in this region. The oscillating and rotating movement of the workpiece also causes comparatively large deformation of a soft pressing element, which makes the dimensionally accurate treatment of a workpiece more difficult.

A further belt finishing device is known from EP 2 212 058 B1, in which a pressing belt is provided, which supports the back of a finishing belt. The pressing belt is fastened to two bearings spaced apart from one another such that the pressing belt winds around the workpiece along a partial circumference. As a result of this, contact of a finishing belt across a large contact surface is made possible.

SUMMARY

On this basis, the object of the invention is to provide a particularly reliable belt finishing device.

In a belt finishing device referred to above, this object is achieved according to the invention in that a position detection apparatus for detecting a pressing arm actual position that deviates from a desired position of the pressing arm is provided.

The belt finishing device according to the invention allows undesirable operating states of the belt finishing device to be detected. For this purpose, a position detection apparatus is used, which detects whether the pressing arm is in a position that deviates from the desired position.

Mechanical failure of the belt finishing device occurs, for example, if the pressing element is missing (for example was forgotten when the machine was being set up) or fails during the operation of the belt finishing device. Therefore, it is most advantageous if the desired position of the pressing element corresponds to an intact pressing element and if the actual position of the pressing element corresponds to a missing or defective, in particular broken or torn, pressing element. A failure of the pressing element can therefore be detected promptly and in a simple manner.

It is particularly preferable for the pressing arm to be able to have a pressing force applied to it by means of a force application apparatus such that in the event of a failure of the pressing element, the pressing force causes a movement of the pressing arm out of the desired position into the actual position. In this connection, it has been identified according to the invention that the failure of the pressing element while the force application apparatus is active results in the region of the pressing arm on which the pressing element is arranged continuing to move toward the workpiece surface to be treated as a result of the pressing force.

It is possible for the position detection apparatus to be designed as a displacement or angle measuring device such that a movement path or a swivel angle of the pressing arm is detected.

It is particularly preferable for the position detection apparatus to be designed as a distance measurement apparatus, thus allowing in particular contactless detection of the position of the pressing arm.

The position detection apparatus preferably comprises a first sensor part fixed to the frame and a second sensor part connected to the pressing arm. This allows for a simple construction of the position detection apparatus, which can be retrofitted to already existing conventional belt finishing devices.

The position of a pivotable pressing arm is detected particularly simply and precisely if one of the sensor parts has a curved surface with different radii of curvature and if the other sensor part detects varying distances between the sensor parts over the course of a movement of the pressing arm.

The belt finishing device according to the invention is suitable in particular for pressing elements which are produced from a metal material, in particular spring steel. Metal pressing elements are suitable for transferring comparatively high pressing forces.

It is particularly preferable for the pressing element to be designed as a pressing belt, by means of which the finishing belt can be pressed against a partial circumference of the workpiece surface to be treated. The invention allows a break or tear of such a pressing belt to be detected.

When using a pressing belt, it is possible for this to be made from a metal material and to preferably have a belt thickness of at most up to 1 mm. In this manner, particularly flexible adjustability of the pressing belt to different diameters of workpiece surfaces to be treated is made possible. Adjustability of this type can also be achieved by use of an in particular fiber-reinforced plastics belt, which has, for example, a belt thickness of approximately 3 to 5 mm.

Because a break or tear of the pressing belt can be detected according to the invention, it is also possible to operate a force application apparatus of the pressing arm such that it is possible to generate comparatively high pressing forces which substantially use up the strength reserves of the pressing belt. If a break or tear does nevertheless occur, such a break or tear can be detected according to the invention and the broken or torn pressing belt can be replaced by a new, intact pressing belt.

Furthermore, it is preferable for a pressing surface of the pressing element interacting with a reverse side of the finishing belt to have a friction-enhancing surface structure (for example a roughening with a roughness depth Rz of at least 0.03 mm, preferably of up to 0.07 mm) and/or a friction-enhancing coating (in particular a diamond particle layer, preferably applied galvanically). As a result of this, an increase in the friction between the pressing element and the finishing belt can be achieved. This holds the finishing belt more effectively against slipping due to the oscillating movement of the finishing belt or of the workpiece.

Furthermore, the invention relates to a method for operating a belt finishing device, particularly a device as described above, including a frame for mounting a pressing arm, in particular pivotally, a pressing element being arranged on the pressing arm, by means of which element a finishing belt can be pressed against a workpiece surface to be treated.

To allow particularly secure operation of the belt finishing device, it is proposed according to the invention that a missing or defective pressing element is detected by an actual position of the pressing arm that deviates from a desired position of the pressing arm being detected.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
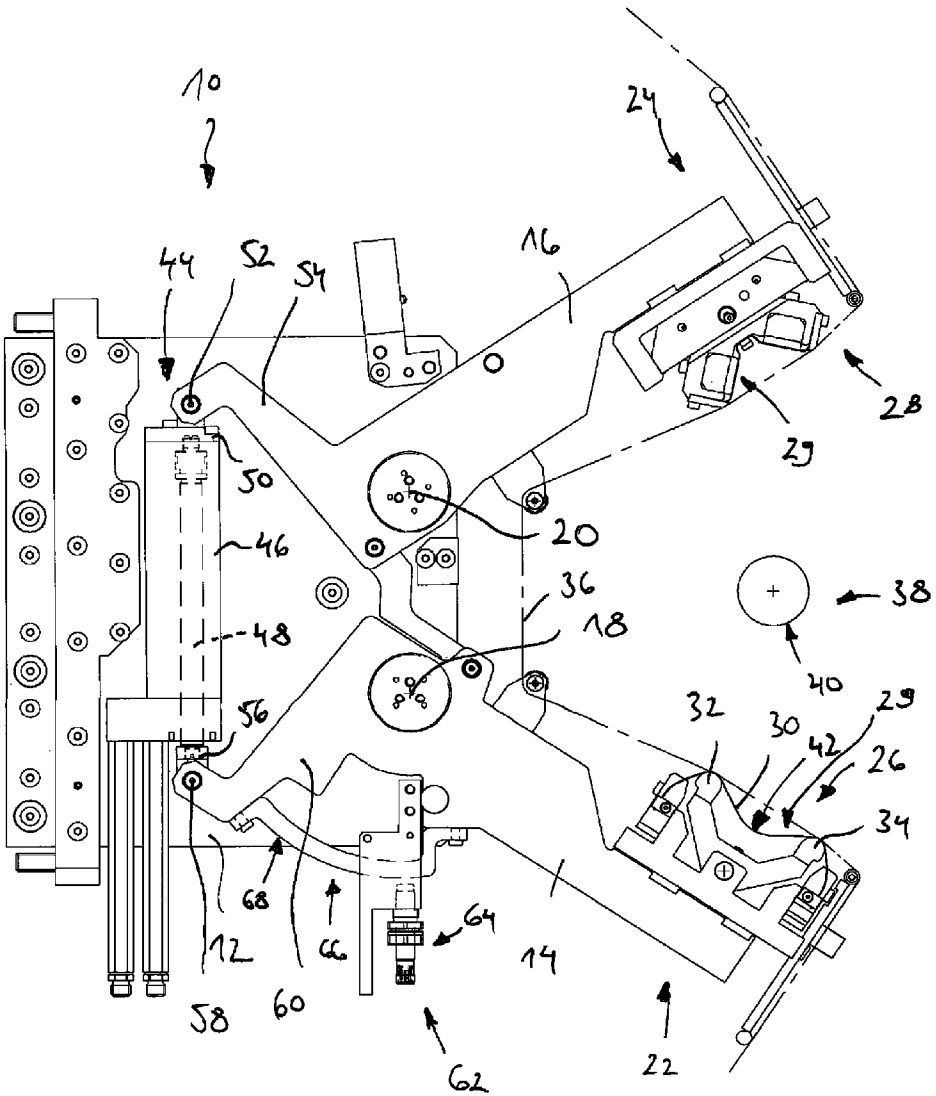
FIG. 1 is a side view of a belt finishing device in a state preparing for work, including a pressing arm and a pressing element.

An embodiment shown in the drawings of a belt finishing device is denoted as a whole with the reference numeral 10. The device 10 has a frame 12, which is used to pivotally mount two pressing arms 14 and 16 about respective pivot axes 18, 20. The frame 12 is movably arranged on a stationary machine frame, or the frame 12 is an immovable component of a stationary machine frame.

The pressing arms 14 and 16 each have a free end 22, 24, on each of which a pressing apparatus 26, 28 is arranged. The pressing apparatuses 26, 28 are provided with pressing elements 29. The pressing apparatus 26 has a pressing element 29 in the form of a curved, flexible pressing belt 30. The pressing belt 30 is preferably supported at two support points 32, 34 spaced apart from one another and fixed to the pressing apparatus 26 at its belt ends facing away from one another.

The pressing element 29 of the pressing apparatus 28 is, for example, V-shaped and has two pressing portions at angles to one another.

Figure 2:
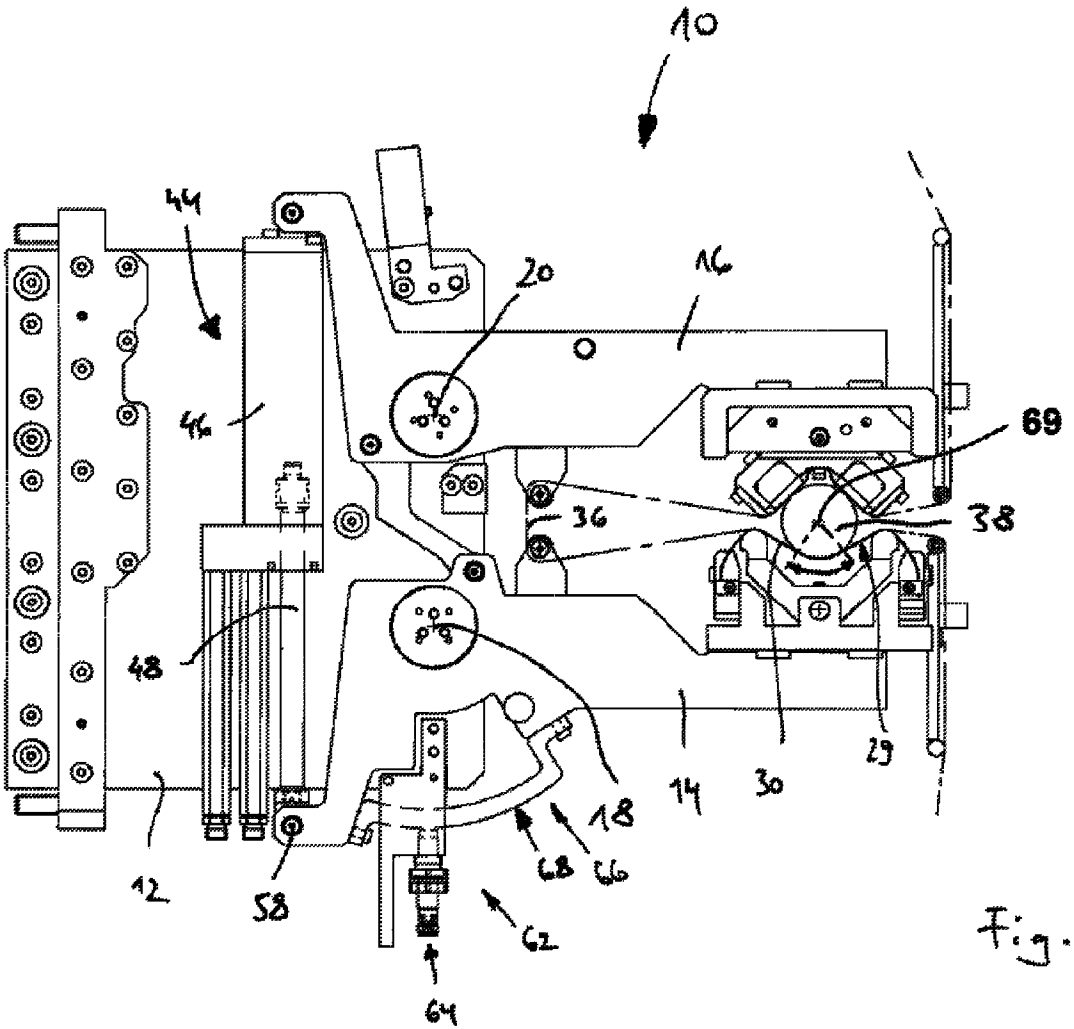
FIG. 2 is a side view according to the view in FIG. 1 of the belt finishing device in an operating state in which a workpiece is being finished, the pressing element being intact and the pressing arm assuming a desired position.

The pressing elements 29 of the pressing apparatuses 26, 28 are used to apply a pressing force to a reverse side of a finishing belt 36 facing the pressing apparatuses 26, 28 in order to press a front side of the finishing belt 36 facing a workpiece 38 against a workpiece surface 40 to be treated of the workpiece 38, cf. FIG. 1 and FIG. 2. In the process, it is possible for a pressing surface 42 of a pressing element, for example a pressing belt 30, interacting with the reverse side of the finishing belt 36 to have a friction-enhancing surface structure and/or a friction-enhancing coating, in particular diamond particles.

It is understood that the pressing apparatuses 26, 28 can also be designed to be identical to one another or that the pressing apparatus 26 shown in the drawings can also be arranged in its installed position above the pressing apparatus 28 shown in the drawings.

To generate a pressing force acting on the finishing belt 36 and therefore on the workpiece surface 40, a force application apparatus 44 is provided. The force application apparatus comprises, for example, a cylinder 46 and a piston 48 that is arranged movably inside the cylinder 46. The cylinder 46 is connected by its base 50 by a pivot bearing 52 to a lever 54 of the pressing arm 16. The free piston end 56 of the piston 48 is connected to a lever 60 of the pressing arm 14 via a pivot bearing 58.

To detect the pivot position of the pressing arm 14 about the pivot axis 18, a position detection apparatus 62 is provided. The position detection device 62 comprises a first sensor part 64 fixed to the frame in the form of a distance sensor and a second sensor part 66 which is rigidly connected to the pressing arm 14 and is pivoted together with the pressing arm 14 about the pivot axis 18 when the pressing arm 14 is pivoted.

The second sensor part 66 has a curved surface 68 that faces the first sensor part 64 and has different radii of curvature such that a distance measured between different portions of the curved surface 68 and the first sensor part 64 varies depending on the pivot position of the pressing arm 14 about the pivot axis 18.

In a state preparing for work, the tong-like pressing arms 14 and 16 are opened such that the workpiece surface 40 to be treated, for example the circumferential bearing surface of a main crankshaft bearing or a crankshaft large end bearing, can be positioned freely relative to the pressing apparatuses 26, 28. In this work preparation state, the piston 48 is at least largely fully retracted into the cylinder 46, cf. FIG. 1. Starting from here, pneumatically or hydraulically generated extension of the piston 48 out of the cylinder 46 causes closure of the tong-like pressing arms 14 and 16 such that the pressing apparatuses 26 and 28 are each moved toward the workpiece surface 40 to be treated until the finishing belt 36 ultimately has a force applied to it by the pressing apparatuses 26 and 28 and is pressed against the workpiece surface 40 to be treated, cf. FIG. 2.

In the region of the pressing belt 30, the finishing belt 36 is pressed across a partial circumference against the workpiece surface 40 to be treated. This partial circumference is indicated in FIG. 2 by dashed lines at angles to one another and by a double-headed arrow. The winding angle assigned to this partial circumference is, for example, between at least approximately 5° and at most approximately 180°.

During the finishing of the workpiece 38, said workpiece rotates about a workpiece axis 69. A rotary drive, which is known per se and is therefore not shown in the drawings, is provided for this purpose. An oscillating movement is superimposed on the rotary movement of the workpiece 38, and specifically in the form of a periodic movement of the workpiece to and fro in a direction parallel to the workpiece axis 69 (i.e. perpendicular to the drawing plane of FIGS. 1 to 3).

In order to allow the pressing belt 30 to be able to cling as flexibly as possible to the workpiece surface 40 to be treated of workpieces 38 having different diameters from one another, the pressing belt 30 has a comparatively low belt thickness of, for example, at most 1 mm. Therefore, the pressing belt 30 has a curvature adjusted depending on a diameter of a workpiece surface to be treated.

In particular when the pressing surface 42 of the pressing belt 30 has a friction-enhancing surface structure (for example a roughening) and/or a friction-enhancing coating (for example diamond particles), increased frictional forces act between the pressing surface 42 and the reverse of the finishing belt 36 and are oriented according to the oscillation movement in parallel with the workpiece axis 69 and in opposite directions to one another. These frictional forces can lead to the pressing belt 30 breaking or tearing such that the pressing belt 30 cannot transfer any pressing force onto the finishing belt 36 anymore.

Figure 3:
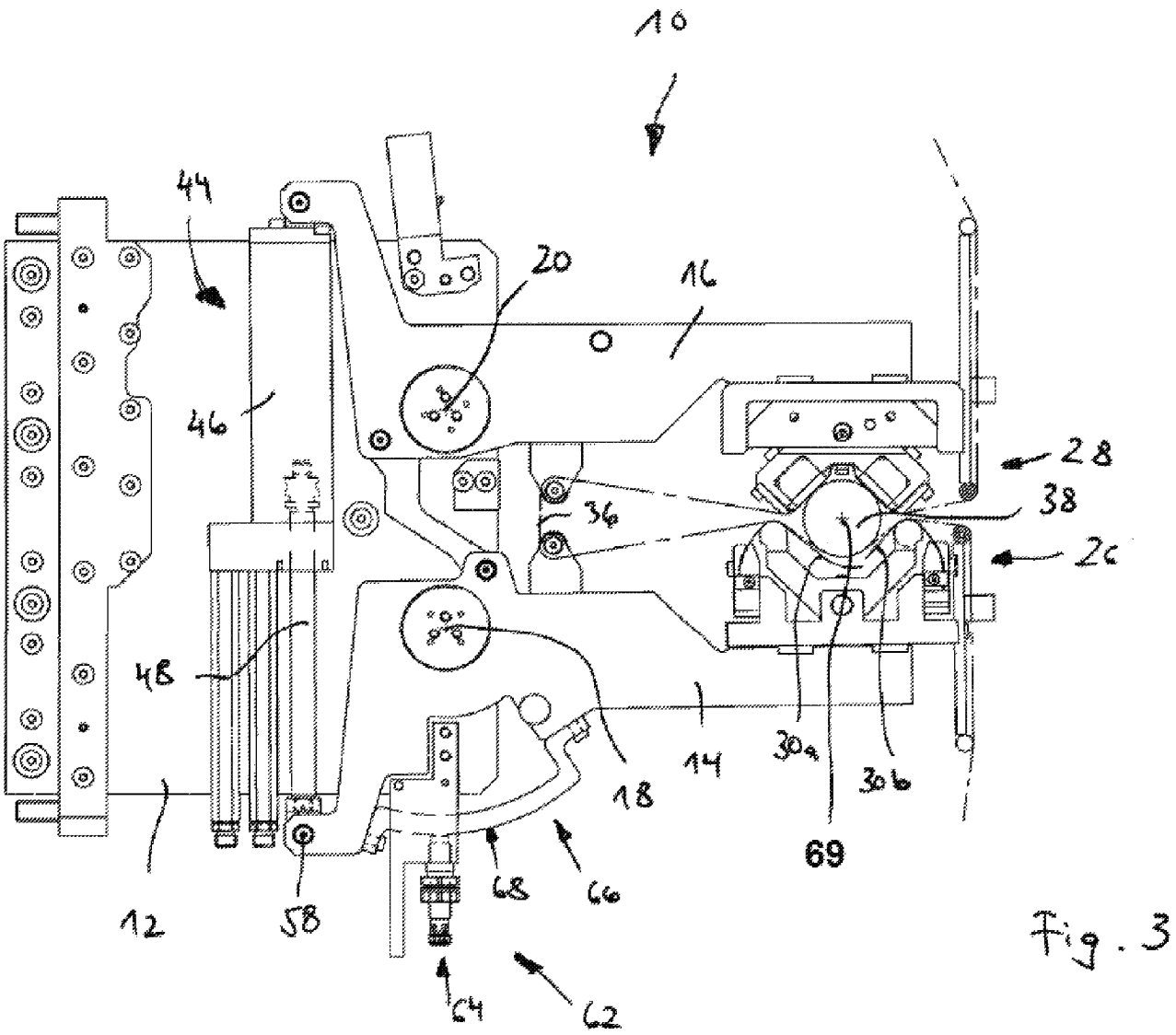
FIG. 3 is a view according to FIG. 2, the pressing arm assuming an actual position that deviates from the desired position after the pressing element has broken.

In FIG. 3, the pressing belt 30 is shown in a broken or torn state in which the pressing belt 30 has two pressing belt portions 30*a* and 30*b* separated from one another. Starting from the state shown in FIG. 2, in which the pressing arm 14 assumes a desired position, i.e. the pressing belt 30 is not broken or torn, a break or tear of the pressing belt 30 leads to the force application apparatus 44, in particular its piston 48, pivoting the pressing arm 14 about the pivot axis 18 such that the pressing apparatus 26 moves further toward the workpiece axis 69 of the workpiece 38 (cf. FIG. 3). In this state, the pressing arm 14 assumes an actual position, which deviates from the desired position when the pressing belt 30 is intact.

This deviation of the actual position of the pressing arm from a desired position can be detected by a position detection apparatus 62 since the distance between the first sensor part 64 and the respective portions of the curved surface 68 of the second sensor part 66 changes over the course of the movement of the pressing arm 14.

Advantageously, the position detection apparatus 62 is coupled to a controller of the belt finishing device 10 such that the detection of the transfer of the pressing arm 14 out of the desired position into a deviating actual position is accompanied by the generation of a warning signal and/or with an end to the finishing treatment of the workpiece 38.

At a realistic scale shown in the drawings, the change of the pivot angle of the pressing arm 14 from the desired position into the deviating actual position can be relatively small. When using a force application apparatus 44, the stroke of the piston 48 accompanying such a pivoting of the pressing arm 14 is thus likewise comparatively small. Comparing FIG. 2 and FIG. 3, it can be seen that the displacement of the piston 48 when the pressing arm 14 is pivoted out of the desired position into the deviating actual position is accompanied by a correspondingly slight displacement of the pivot bearing 58 relative to the frame 12.

Additionally or alternatively to the position detection apparatus 62 described above, it is also possible to detect the stroke of the piston 48 relative to the cylinder 46, in particular using a displacement measuring system.

In an alternative embodiment, the pressing arms 14, 16 are not pivotally mounted, but can move along a linear movement path. In this case, it is proposed with respect to the position detection apparatus 62 that the second sensor part 66 does not have a curved surface 68 but rather a straight plane inclined relative to the movement axis of the pressing arm 14 such that a distance between different portions of the plane and the first sensor part 64 fixed to the frame changes over the course of a movement of the pressing arm 14.

The invention has been described above with reference to the pressing element 29 in the form of a pressing belt 30; it is, however, understood that a position detection apparatus 62 can, additionally or alternatively, also be provided on the pressing arm 16 in order to be able to detect a failure, in particular a breakage, of the prismatic pressing element 29 of the pressing apparatus 28.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A belt finishing device comprising:

a frame;

a pressing arm mounted to the frame;

a pressing element arranged on the pressing arm;

a finishing belt disposed on the pressing element and configured to press against a workpiece surface to be treated; and a position detection apparatus configured to detect an actual position of the pressing arm that deviates from a desired position of the pressing arm.

2. The belt finishing device according to claim 1, wherein the desired position corresponds to an intact pressing element and the actual position corresponds to a missing or defective pressing element.

3. The belt finishing device according to claim 1, wherein a pressing force is applied to the pressing arm by a force application apparatus.

4. The belt finishing device according to claim 1, wherein the position detection apparatus is a displacement or angle measurement apparatus.

5. The belt finishing device according to claim 1, wherein the position detection apparatus is a distance measurement apparatus.

6. The belt finishing device according to claim 1, wherein the position detection apparatus comprises a first sensor part fixed to the frame and a second sensor part connected to the pressing arm.

7. The belt finishing device according to claim 1, wherein the pressing element is produced from a metal material.

8. The belt finishing device according to claim 1, wherein the pressing element is a pressing belt configured to press the finishing belt against a partial circumference of the workpiece surface to be treated.

9. The belt finishing device according to claim 1, wherein a pressing surface of the pressing element interacting with a reverse side of the finishing belt has one or both of a friction-enhancing surface structure and a friction-enhancing coating.

10. A method of operating the belt finishing device according to claim 1, comprising:

detecting when the pressing element is missing or defective by detecting when the actual position of the pressing arm has deviated from the desired position of the pressing arm.

11. The belt finishing device according to claim 7, wherein the pressing element is spring steel.

12. The belt finishing device according to claim 1, wherein the pressing arm is pivotally mounted to the frame.

13. A belt finishing device comprising:

a frame;

a pressing arm mounted to the frame;

a pressing element arranged on the pressing arm;

a finishing belt disposed on the pressing element and configured to press against a workpiece surface to be treated; and a position detection apparatus configured to detect an actual position of the pressing arm that deviates from a desired position of the pressing arm, wherein the position detection apparatus comprises a first sensor part fixed to the frame and a second sensor part connected to the pressing arm, and wherein one of the sensor parts has a curved surface with varying radii of curvature and the other sensor part detects varying distances between the sensor parts over the course of a movement of the pressing arm.

* * * * *